US010653257B2

(12) United States Patent
Bishop

(10) Patent No.: US 10,653,257 B2
(45) Date of Patent: May 19, 2020

(54) WINE BOTTLE AND GLASS CARRIER

(71) Applicant: Mischa Bishop, Muscle Shoals, AL (US)

(72) Inventor: Mischa Bishop, Muscle Shoals, AL (US)

( * ) Notice: Subject to any disclaimer, the term of this patent is extended or adjusted under 35 U.S.C. 154(b) by 0 days.

(21) Appl. No.: 16/245,957

(22) Filed: Jan. 11, 2019

(65) Prior Publication Data

US 2019/0142195 A1 May 16, 2019

Related U.S. Application Data

(63) Continuation-in-part of application No. 29/618,988, filed on Sep. 26, 2017, now Pat. No. Des. 840,766.

(51) Int. Cl.
*A47G 23/02* (2006.01)

(52) U.S. Cl.
CPC ..... *A47G 23/0241* (2013.01); *A47G 23/02* (2013.01); *A47G 23/0208* (2013.01)

(58) Field of Classification Search
CPC ..... A47G 23/00–0241; A47G 23/02; A47G 23/0208; B65D 23/0892; B65D 23/102; B65D 23/104; B65D 25/28
USPC ..... 220/737, 752–776; 215/395
See application file for complete search history.

(56) References Cited

U.S. PATENT DOCUMENTS 4,248,366 A * 2/1981 Christiansen ..... A45F 5/00 220/903
4,796,937 A * 1/1989 Andrea ..... B65D 23/0842 215/396
5,147,079 A * 9/1992 Heather ..... A45F 3/02 206/428
5,624,048 A * 4/1997 Sander ..... B65D 81/3893 215/395
6,378,924 B1 * 4/2002 McCrumb ..... B65D 23/106 215/396
6,481,239 B2 * 11/2002 Hodosh ..... A45C 11/20 220/592.17
9,139,352 B2 * 9/2015 Seiders ..... B65D 25/205
2005/0145632 A1 * 7/2005 Cocca ..... B65D 25/16 220/495.01
2014/0021730 A1 * 1/2014 Miwa ..... A47G 23/0216 294/27.1
2014/0054305 A1 * 2/2014 Robbins, III ..... B65D 23/104 220/710.5

* cited by examiner

*Primary Examiner* — Kareen K Thomas
(74) *Attorney, Agent, or Firm* — Dennen IP Law, LLC

(57) ABSTRACT

A wine bottle and glass carrier has an arch-shaped handle and a housing attached to the arch-shaped handle, the housing having an outside surface, the outside surface comprising a plurality of concave cavities with a centralized protrusion, the protrusion configured for retaining a mouth of a glass and the concave cavity configured for retaining the body of a glass.

10 Claims, 7 Drawing Sheets

WINE BOTTLE AND GLASS CARRIER

CROSS-REFERENCE TO RELATED APPLICATION

This application is a continuation-in-part of and claims priority to U.S. Design patent application Ser. No. 29/618,988 entitled Wine Carrier and filed on Sep. 26, 2017, which is incorporated herein by reference in its entirety.

BACKGROUND

At parties or other types of events, attendees often bring wine to be shared by the participants of the event. Oftentimes, attendees also bring glasses in which to serve the wine. When served to participants at the event, an attendee obtains a glass and wine is poured in the glass.

Sometimes individuals go to events that are outside, for example. To the event, the individual may desire to bring wine. However, at the event no wine glasses are available.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure describes a wine bottle and glass carrier in accordance with an embodiment of the present disclosure. The wine bottle and glass carrier comprises a generally cylindrical housing that is coupled on an open end to a handle. On the outer surface of the housing is one or more cavities configured to retain one or more glasses. Within the housing is a chamber, and the chamber comprises a removable member. The removeable member comprises a generally cylindrical hollow container for holding a bottle of wine. Coupled to the generally cylindrical hollow container are generally rectangular extensions that extend from the top of the container to the bottom of the container. The extensions extend from the container and comprise a coupling means that couple the extensions to an inside surface of the housing in order to keep the container upright during transport.

Figure 1:
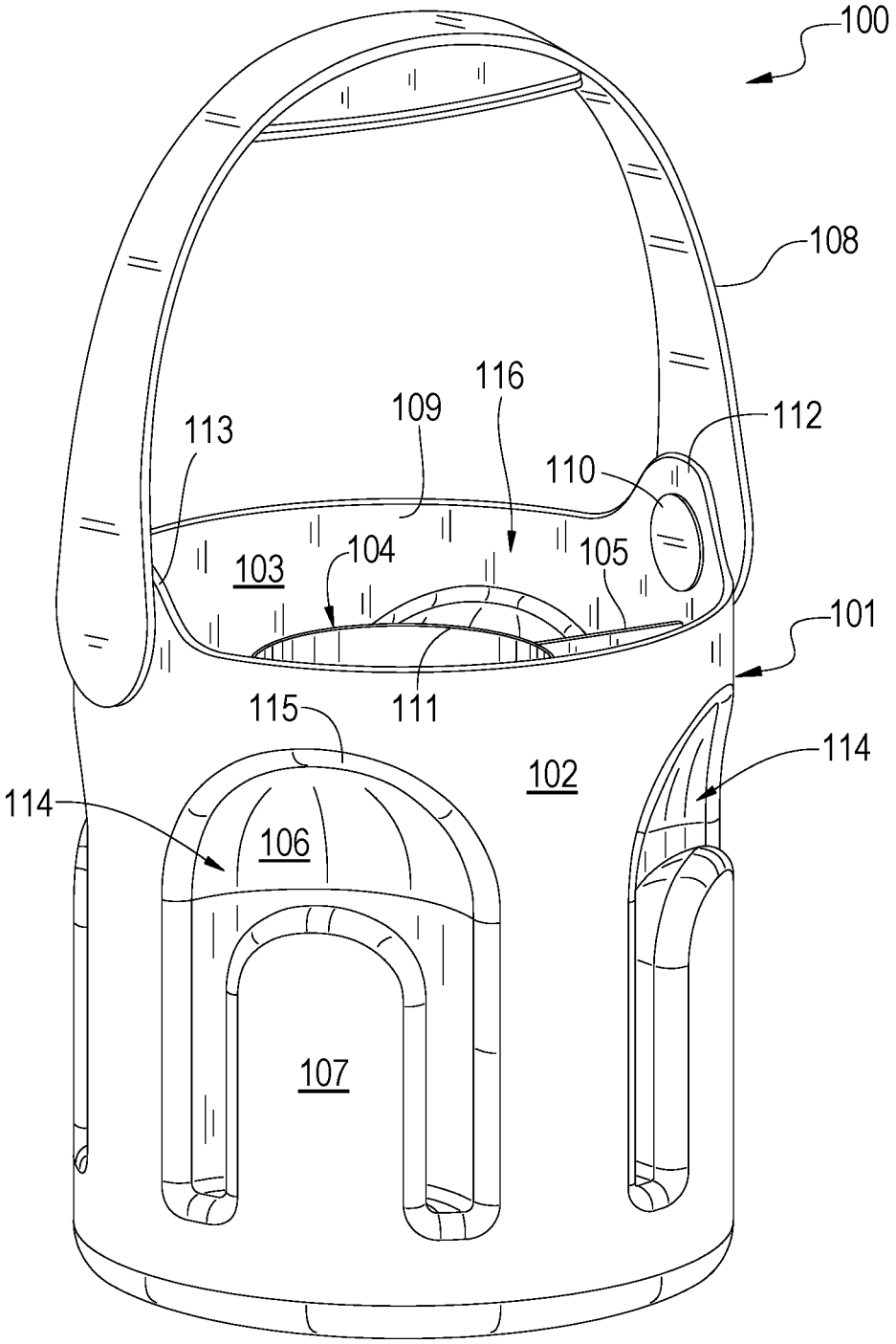
FIG. 1 is a perspective view of a wine carrier in accordance with an embodiment of the present disclosure.

FIG. 1 is a perspective view of a wine bottle and glass carrier 100 in accordance with an embodiment of the present disclosure. The wine bottle and glass carrier 100 comprises a generally cylindrical housing 101. An arch-shaped handle 108 is coupled to extensions 112 and 113 of the housing 101 via fastener 110. Only one fastener is shown in FIG. 1; however, in the embodiment shown there is also a fastener that fastens extension 113 to the handle 108.

The wine bottle and glass carrier 100 further comprises a plurality of concave cavities 106 formed in an outside surface 102 of the housing 101. In the present disclosure, the wine carrier 100 comprises four concave cavities 106 placed on four sides of the housing 101. However, more or fewer concave cavities 106 may be used in other embodiments.

Each concave cavity 106 is arch-shaped and its concavity extends inwardly into the housing 101. Further, each concave cavity 106 comprises a corresponding arch-shaped protrusion 107 that is smaller in height than the concave cavity 106 and is integral with the outside surface 102 of the housing 101. Between an edge 115 of the concave cavity 106 and the protrusion there is an arch-shaped space 114. Thus, a mouth of a glass (not shown) may be placed over the protrusion 107, and the body of the glass fits within the concave cavity 106. The protrusion retains the glass in the concave cavity 106.

In one embodiment, the housing 101 is made of Acrylonitrile butadiene styrene (ABS) plastic. In another embodiment, the housing 101 made of fabric. In such an embodiment, a waxed canvas can be used with a thin layer of polyethylene or polypropylene that is sewn between the two layers of fabric, i.e., the fabric on the interior of the housing 101 and the fabric on the exterior of the housing 101. In another embodiment, the housing 101 is made of leather, and no plastic sheet would be needed for structure.

The wine bottle and glass carrier 100 further comprises a removeable wine bottle holder 104. The wine bottle holder 104 fits within the opening 109 of the housing 101 and is secured in a chamber 116. The wine bottle holder 104 comprises a generally cylindrical container 111 in which a bottle of wine is inserted. The generally cylindrical container 111 has a diameter that is less than the diameter of the chamber 116.

The wine bottle holder 104 further comprises generally rectangular wings 105 that extend perpendicular from the generally cylindrical container 111 from the top of the wine holder 105 to the bottom of the wine holder 104. The wings 105 couple with an inside surface 103 of the housing 101. The generally rectangular wings 105 therefore retain the generally cylindrical wine bottle holder 104 within the housing 101 during transport.

In one embodiment, the wine bottle holder 104 is made of neoprene to hug a bottle (not shown) inserted therein. Further, wings 105 may comprise flaps that attach to the inside walls of the housing 101 with Velcro. This will allow the wine bottle holder 104 to be easily removed for cleaning both the wine holder and the inside of the housing 101.

Figure 2:
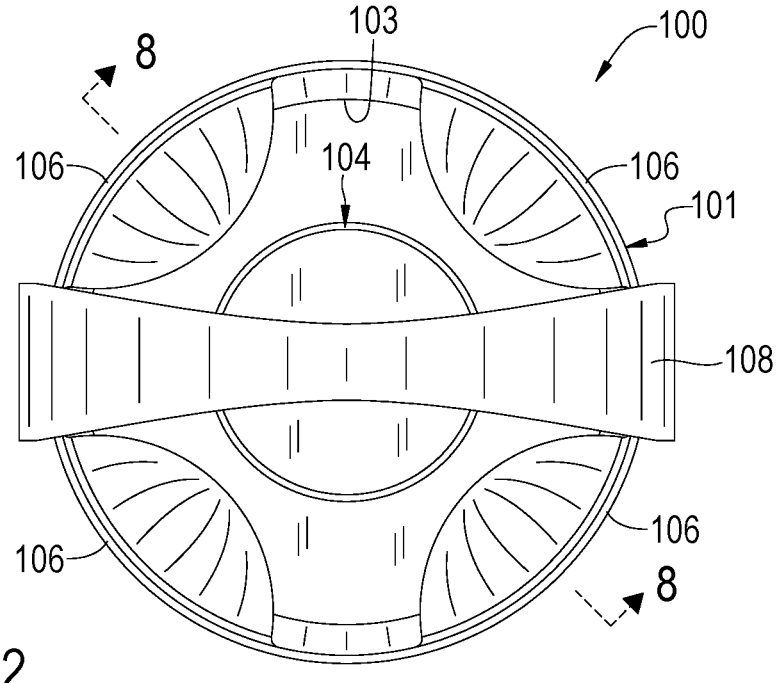
FIG. 2 is a top view of the wine carrier of FIG. 1.

FIG. 2 is a Lop view of the wine carrier 100. The top view depicts the generally cylindrical wine bottle holder 104 disposed in the center of the housing 101. The wings 105 that couple the generally cylindrical wine bottle holder 104 to the inside surface 103 of the housing 101 are not shown because they are disposed underneath the handle 108.

FIG. 2 further depicts the plurality of concave cavities 106. The concave cavities 106 have inside surfaces 200 that protrude into the housing 101. The concave cavities 106 are formed so that each can retain a glass within the concave cavities 106.

Figure 3:
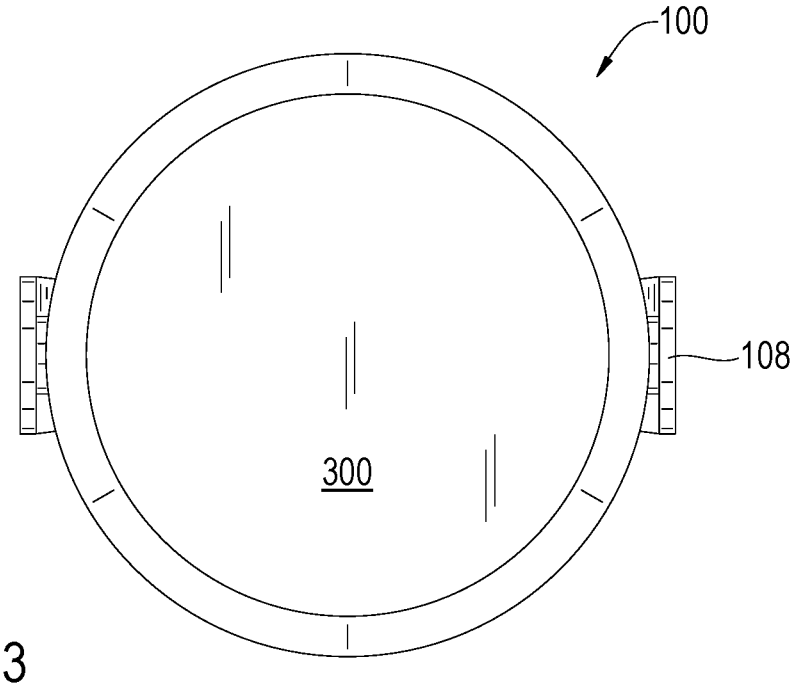
FIG. 3 is bottom view of the wine carrier of FIG. 1.

FIG. 3 is a bottom view of the wine carrier 100. The wine carrier 100 comprises a bottom member 300. Further, FIG. 3 shows the handle 108 protruding from opposing sides of the wine carrier 100.

Figure 4:
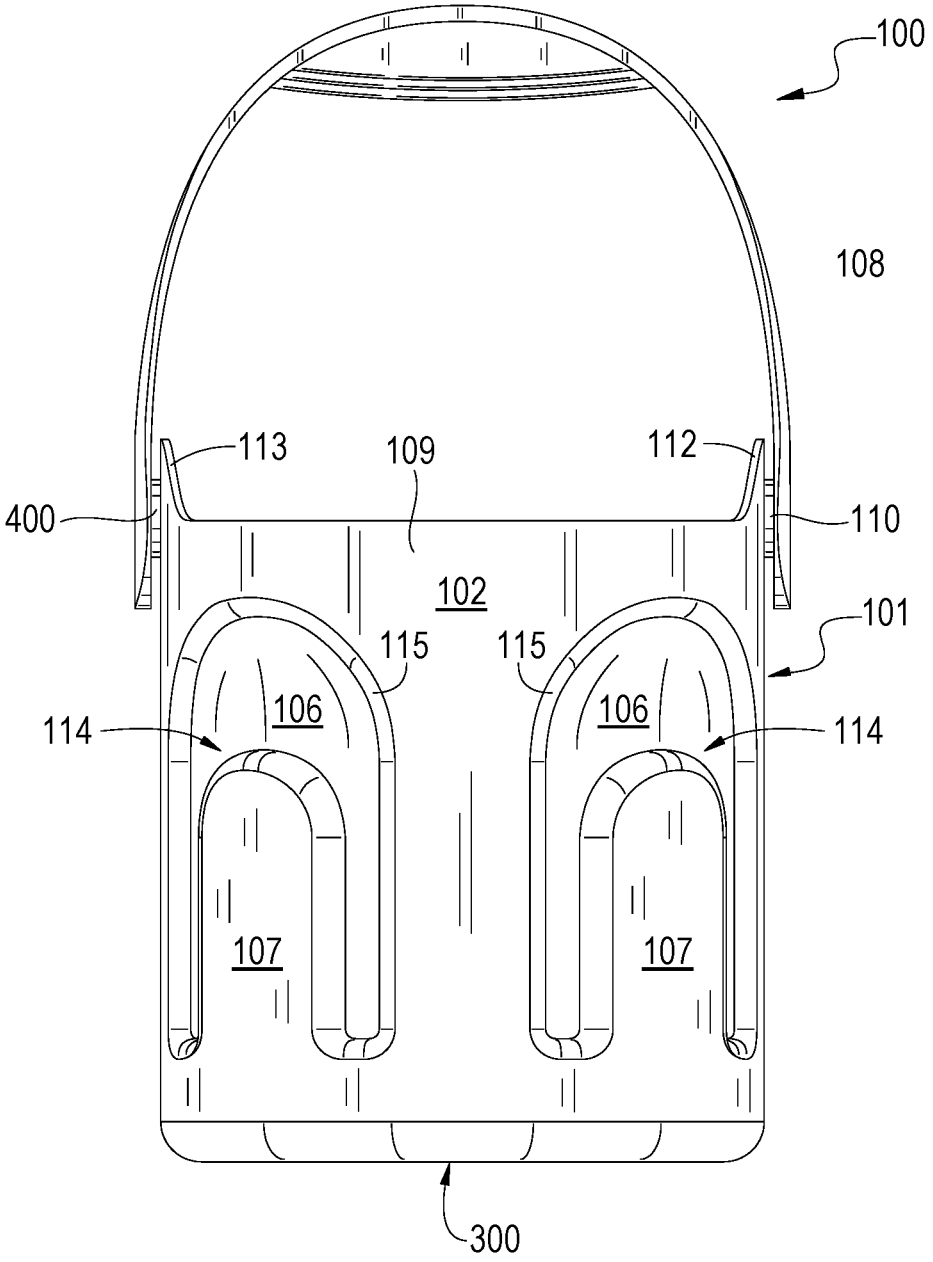
FIG. 4 is a front side view of the wine carrier of FIG. 1.

FIG. 4 is a side view of the wine carrier 100 wherein the side view shows the handle 108 extending from one side of the housing 101 to the other. The handle 108 is coupled to the extensions 112 and 113 via the fastener 110 and a fastener 400.

The side view in FIG. 4 shows two concave cavities 106 each with a corresponding protrusion 107. The concave cavities 106 are arch-shaped as well as the corresponding protrusions 107. The protrusions 107 are smaller in height than the edge 115 of the concave cavities 106. The arch-shaped spaces 114 are configured to receive glasses. The mouths of the glasses go over the protrusions 107, and a portion of the remainder of the glasses reside in the concave cavities 106.

Note that the wine carrier 100 comprises a bottom member 300. This bottom member 500 ensures that the wine bottle holder 104 (FIG. 1) remains inside the housing 101.

Figure 5:
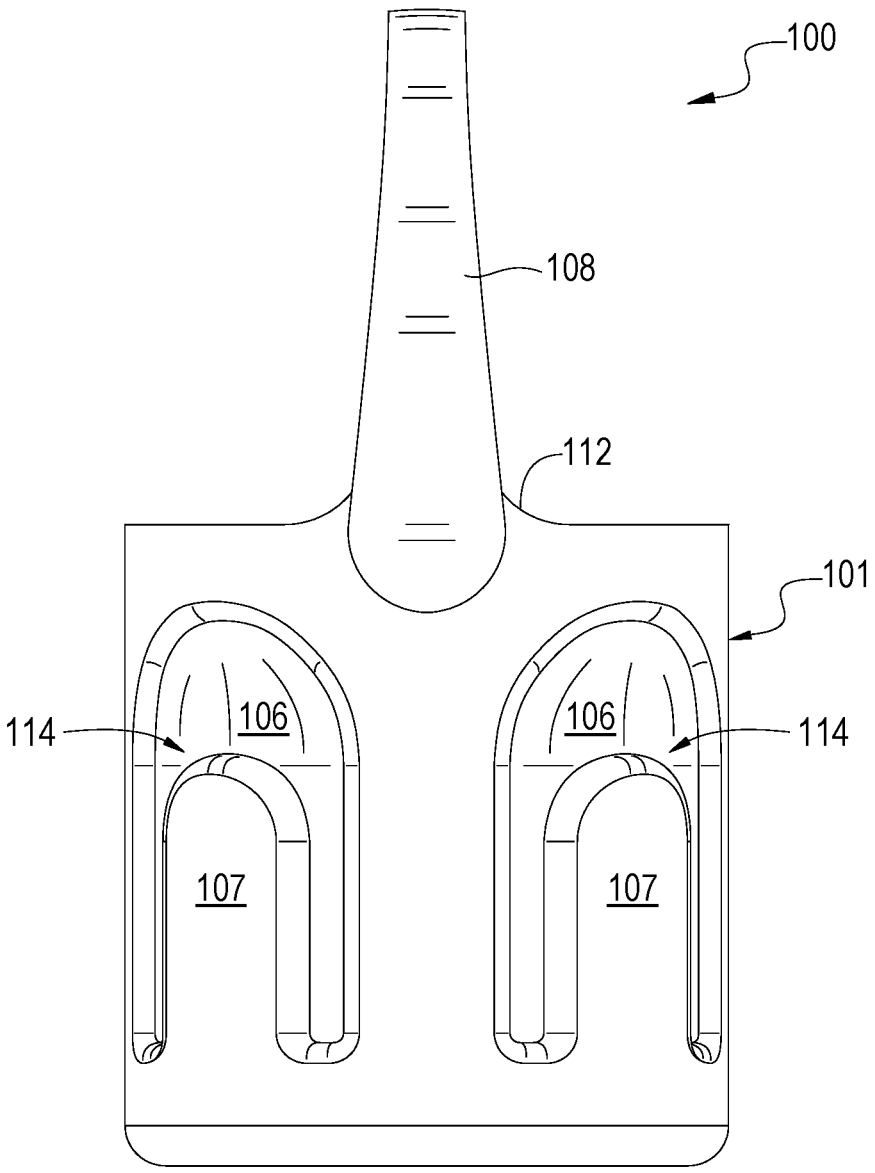
FIG. 5 is a side view of the wine carrier of FIG. 1.

FIG. 5 is a side view of the wine carrier 100 wherein the side shown is the side where the handle 108 couples to an extension 112. FIG. 5 shows two concave cavities 106 and two respective protrusions 107. In use, mouths of glasses are placed over the protrusions 107 to retain the glasses. A portion of the remainder of the glasses fit within the concave cavities 106.

Figure 6:
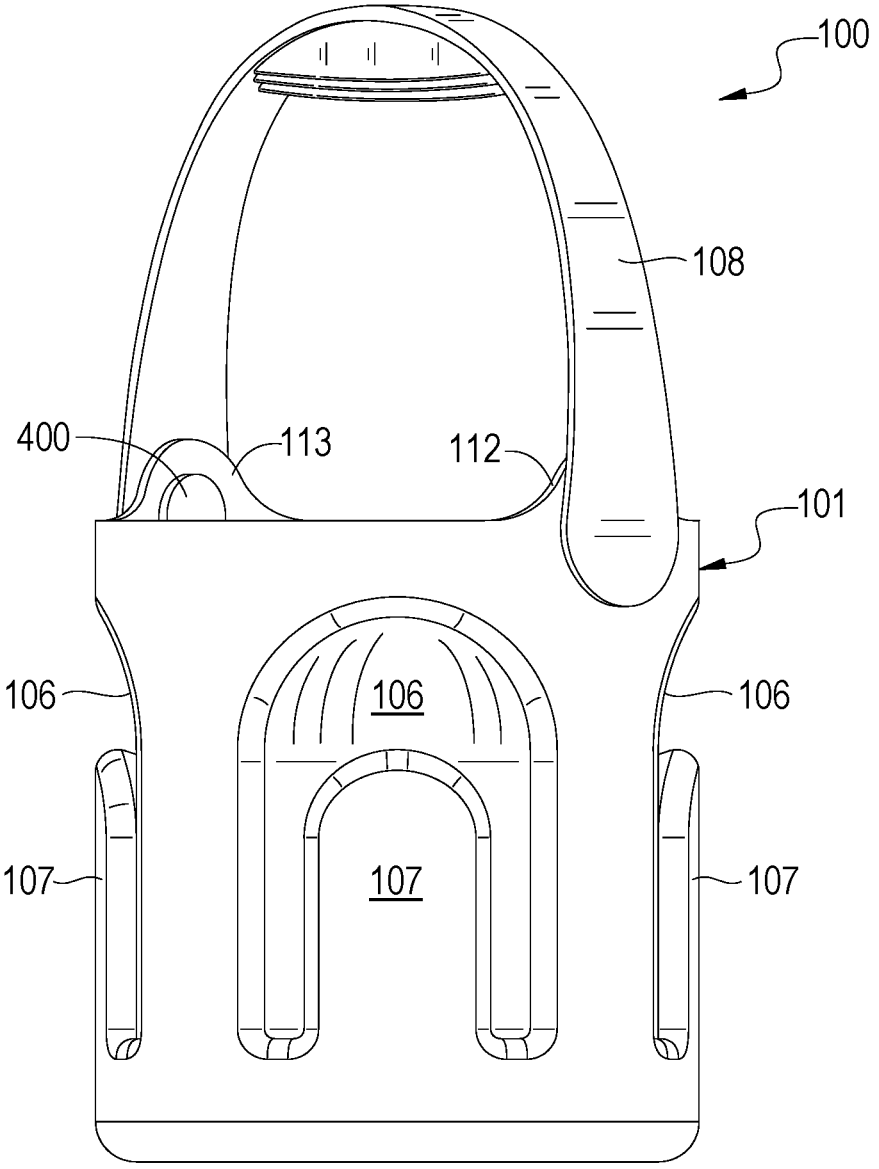
FIG. 6 is an offset side view of the wine carrier of FIG. 1.

FIG. 6 is a side view of the wine carrier 100 wherein one of the concave cavities 106 is shown centered in the view shown. Further, on each side of the centered concave cavity is additional concave cavities 106. Note that each concave cavity comprises a respective protrusion 107. In use, mouths of glasses are placed over the protrusions 107 to retain the glasses. A portion of the remainder of the glasses fit within the concave cavities 106.

Figure 7:
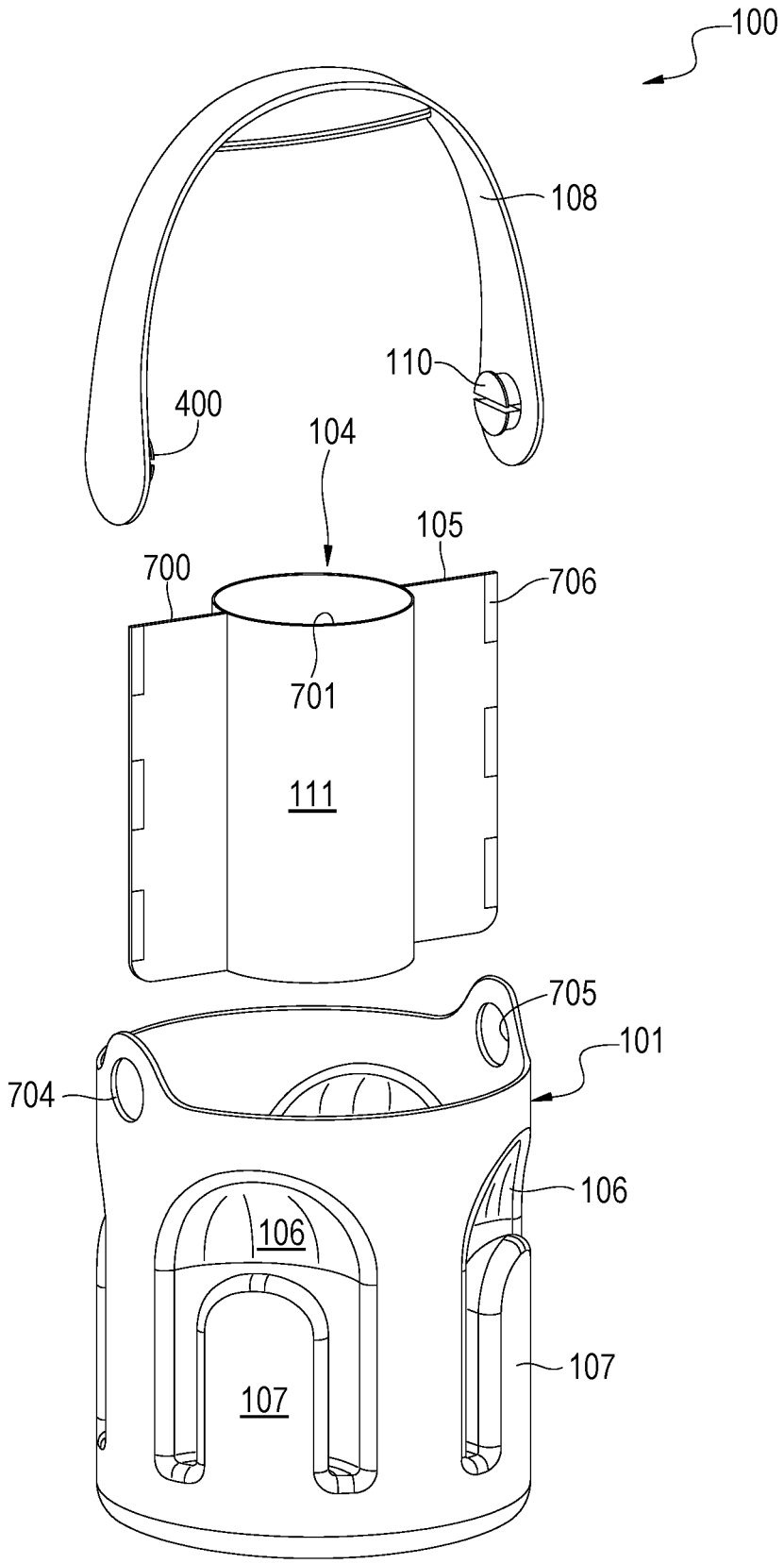
FIG. 7 is an exploded perspective view of wine carrier of FIG. 1.

FIG. 7 is an exploded view of the wine carrier 100. The wine carrier 100 comprises the handle 108, the wine bottle holder 104, and the housing 101. The handle 108 attaches to the housing 101 by inserting the fasteners 111 and 400 into the openings 705 and 704, respectfully. A wine bottle (not shown) is placed in an opening 701 of the wine bottle holder 104, and the wine bottle holder 104 is inserted into housing 101.

Note that the wine bottle holder 104 comprises the rectangular wings 105 and 709. These rectangular wings 105 and 709 extend perpendicularly form the sides of the cylinder 111 of the wine bottle holder 104. They extend outwardly and couple to the inside surface 103 of the housing 101. In this regard, the wings 105 and 709 may comprise flaps 706 that attach to the inside surface 103 of the housing 101 via Velcro®.

The housing 101 houses both the wine bottle holder 104 and a plurality of glasses (not shown). In this regard, the wine bottle holder 104 is inserted into the housing 101 and is coupled thereto. Further, one or more glasses are inserted into the concave cavities 106 wherein the mouth of the glass being inserted fits over the protrusions 107. Thus, the wine bottle and the glasses may be transported for use.

Figure 8:
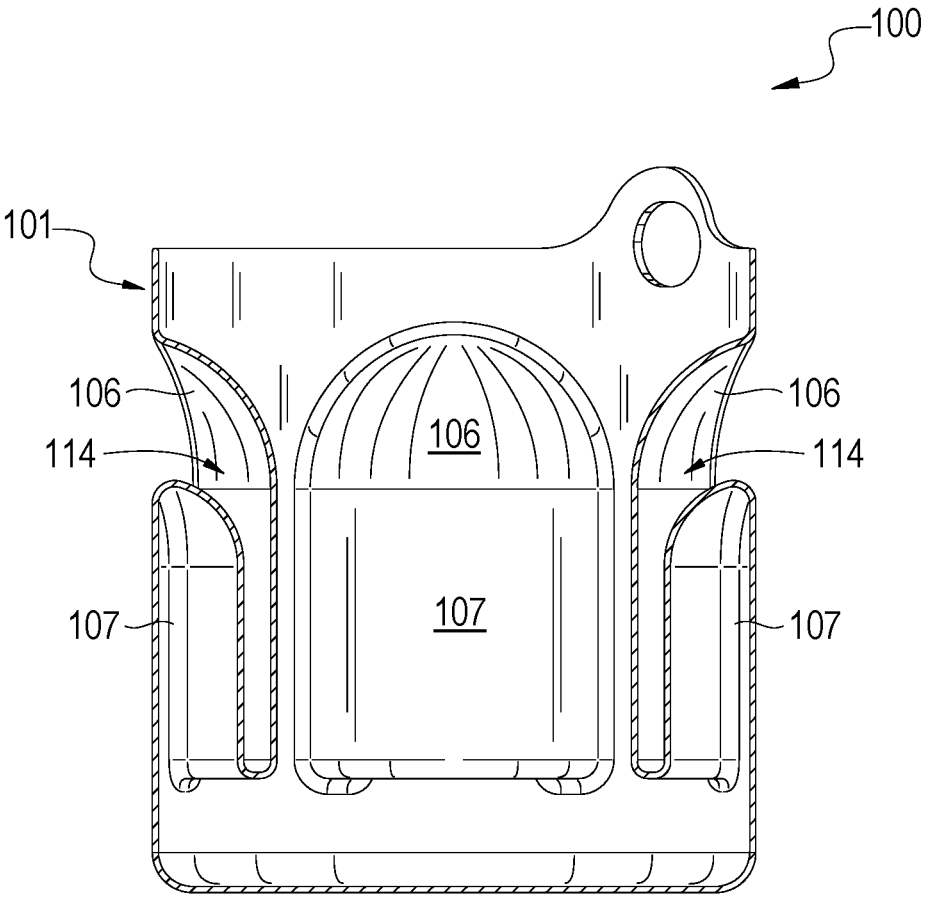
FIG. 8 is a cross-section view of a container of the wine carrier of FIG. 1.

FIG. 8 is a cross-sectional view of the wine carrier 100. As shown, the housing 101 comprises a plurality of concave cavities 106. Each concave cavity 106 has a protrusion 107 that is smaller in height than the concave cavities 106. Thus, an arch-shaped space 114 is created in which a portion of a remainder of a glass may fit when the mouth of the glass is placed over the protrusions 107.

What is claimed is:

1. A wine bottle and glass carrier, comprising:

an arch-shaped handle; and a housing attached to the arch-shaped handle, the housing having an outside surface, the outside surface comprising a plurality of concave cavities with a centralized protrusion, the protrusion configured for retaining a mouth of a glass and the concave cavities are configured for retaining a body of the glass, wherein within a chamber is a removeable generally cylindrical wine holder for holding a bottle of wine and wherein the wine holder comprises at least two perpendicular wings that extend to an inside surface of the housing.

2. The wine bottle and glass carrier of claim 1, wherein the housing has an opening and the inside surface accessed by the opening.

3. The wine bottle and glass carrier of claim 2, wherein the concave cavities extend into the inside surface.

4. The wine bottle and glass carrier of claim 1, wherein the housing comprises an opening and the inside surface that define the chamber.

5. The wine bottle and glass carrier of claim 1, wherein the wine holder is made of neoprene.

6. The wine bottle and glass carrier of claim 1, wherein the wings are coupled to one or more flaps that attach to the inside surface via Velcro.

7. The wine bottle and glass carrier of claim 1, wherein the housing is comprised of Acrylonitrile butadiene styrene (ABS) plastic.

8. The wine bottle and glass carrier of claim 1, wherein the housing and the inside surface of the housing are made of fabric.

9. The wine bottle and glass carrier of claim 8, wherein a layer of polyethylene or polypropylene is inserted between the fabric of the housing and the fabric of the inside surface of the housing.

10. The wine bottle and glass carrier of claim 1, wherein the housing and the inside surface of the housing are made of leather.

* * * * *